US005246255A

United States Patent [19]

Forbes et al.

[11] Patent Number: 5,246,255

[45] Date of Patent: Sep. 21, 1993

[54] REPAIR FLANGE

[76] Inventors: Christopher B. Forbes, 200 W. Hyde Park 15-C, Myrtle Beach, S.C. 29572; Renee C. Forbes; Christopher J. Forbes, both of 1 Cross Falls Cir., Sparks, Md. 21152

[21] Appl. No.: 719,942

[22] Filed: Jun. 24, 1991

[51] Int. Cl.[5] ..... F16L 55/00

[52] U.S. Cl. ..... 285/24; 285/56; 4/252.1

[58] Field of Search ..... 285/56, 57, 58, 59, 285/60, 15, 24; 4/252 R

[56] References Cited

U.S. PATENT DOCUMENTS

| | | | |
|---|---|---|---|
| 712,022 | 10/1902 | Underhill | 285/56 |
| 879,176 | 2/1908 | Jackson | 4/252 R |
| 938,533 | 11/1909 | Wheeler | 285/58 |
| 1,533,444 | 4/1925 | Mohr | 285/58 X |
| 3,419,298 | 12/1968 | Worley | 285/58 |
| 4,648,139 | 3/1987 | Stokes | 285/56 X |
| 4,886,302 | 12/1989 | Forbes | 285/56 |

*Primary Examiner*—Dave W. Arola
*Attorney, Agent, or Firm*—Robert Halper

[57] ABSTRACT

A repair flange comprising members of flat thin, preferably non-corrosive sheet material dimensioned so as to be flush mounted over a finished floor surface. The distinguishing features herein are that this repair flange is designed to fit around the necks under the attachment rim of various size closet flanges and has an opening offset from the usual circular opening wherein the inner edges of two flange members can be proximate one another, spaced a distance apart or standard. The flange members wherever their location fit closely around the neck of the closet flange and the repair flange body extends over the floor surface beyond the area encompassed by the rim of the closet flange so that attachment to the floor material can be made beyond the base of the closet flange. The addition of guide marks on the flange members facilitate the positioning of the flange members with respect to the closet flange. Slots in the flange members also simplify adjustment of the same to assure adequate fastening space to the closet flange. Slots also serve to enable shifting of the flanges to avoid damage to the cross webbing at the face of the toilet bowl. Screws for fastening the closet flanges to the flange members through countersunk spacers cushioned by washers enable better fastening and less likelihood of stripping the screws. A multipurpose planer member to extend the anchoring surface over large deteriorated flooring adds support to the toilet and floor systems.

20 Claims, 6 Drawing Sheets

FIG. 12
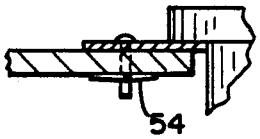
FIG. 12A
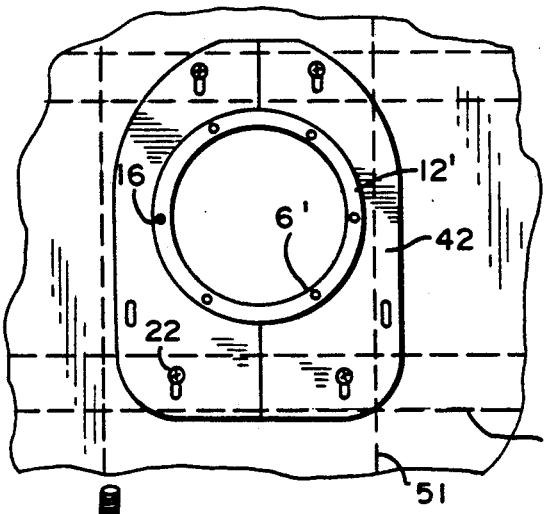
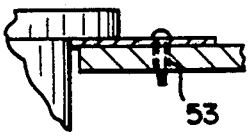
FIG. 12B
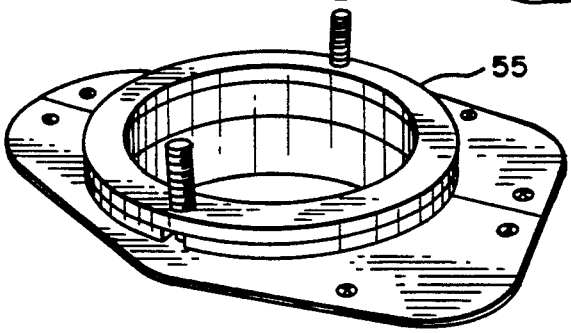
FIG. 13
FIG. 15
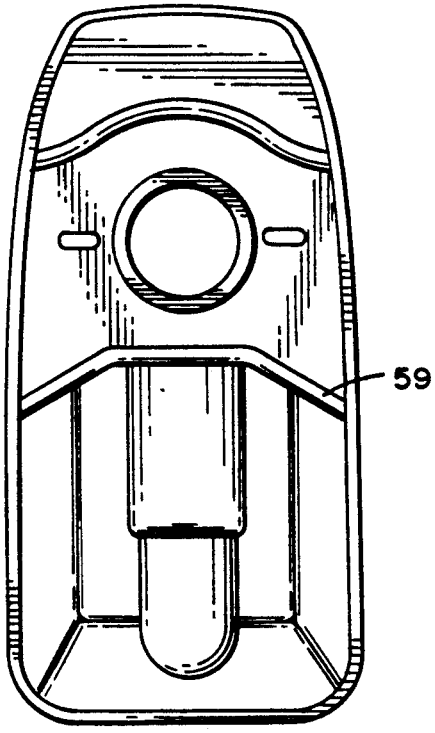
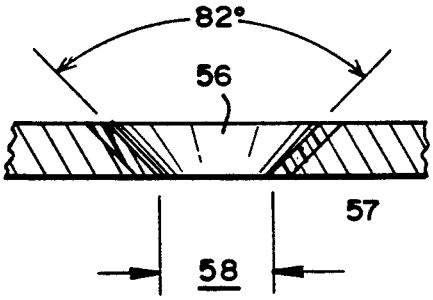
FIG. 14

REPAIR FLANGE

BACKGROUND AND SUMMARY OF THE INVENTION

This invention is an improvement on my earlier invention for repair flange, U.S. Pat. No. 4,886,302 which issued on Dec. 12, 1989. While the aforesaid invention has been received very favorably, there have arisen situations wherein the design described therein is not adequate for the task.

Like the former invention this invention relates to the attachment of toilet bowls to the floor system where the connection is made to the drain pipe. The purpose and function of the repair flange is described in my aforesaid U.S. Pat. No. 4,886,302, and that material is incorporated herein by reference.

The improvements in this application are directed to 10 items:

1) offset openings
2) Slots
3) Guide marks stamped into the parts
4) Countersunk spacers and washers
5) Sizing of flange sections
6) Extended Planar surface
7) Modified Planar surface with attached gasket
8) Support board under the flooring
9) Fastening repair flanges to the floor with hollow wall anchors or toggle bolts
10) Closet rings The improvements in this invention provide a more useful, versatile and effective product that not only provide solutions to common problems outlined in the aforesaid patent regarding the repair of loose closet flanges and toilets, but also address situations where closet flanges are made in a variety of sizes and shapes. In my prior patent the repair flanges were adapted to only one size closet flange. One of the most common problems is the size of a closet flange for different size drain pipes, for example 3 inch and 4 inch drain pipes, the neck of the flanges being about 5¼" to 5⅝". Another involves variable thickness of casing materials that comprise the drain pipe on the neck of a closet flange. The problem arises because the attachment rim of the closet flange is about the same size on all such flanges. Since the screw holes in the rim of a closet flange are located about the same distance from the outside diameter of the flange the screw hole location on the rim of a closet flange with a 5⅝" neck is located closer to the drain pipe or neck beneath the attachment rim of the closet flange. For example one type of closet flange has just ⅜" between the outer periphery of the screw hole and the neck of the flange. Another type such as a cast iron flange has only ⅛" between the neck and the screw hole. On the other hand, the opening between two repair flange sections with adjacent inner edges is 5¼". In this situation for the repair flange to fit tight against the neck of the closet flange and have proper alignment with the screw holes in the closet flange, it is necessary to offset the opening between the repair flange sections. Then the over all length from one side of the repair flange to the other would be 7½", the opening between the flange sections would be circular and the distance from the inner edge of the closet flange neck to the outside edge of the repair flange sections would be 15/16". When the repair flange sections are adjacent each other at the inner edge, the overall distance would be 7⅛" and the opening would be elliptical. In the case of a closet flange with a 5¼" neck diameter, it was found that because of a possibility of misalginment, that it would be preferable to change the circular opening between the repair flange sections to an elliptical opening with the major axis vertically oriented and slightly larger than the minor axis. If the situation occurred where the closet flange was seriously misaligned with respect to the toilet bowl base, the best solution in addition to the elliptical opening would be to stagger the repair flanges. It was also recognized that when the inner edges of the repair flanges are adjacent each other, they must not lap. Otherwise there might be damage to the cross webbing under the toilet bowl base, as elevation caused by the lapping would tend to raise the cross webbing and tilt the toilet bowl.

BRIEF DESCRIPTION OF THE DRAWING

The first

FIG. 1 is a perspective top view of the repair flange consisting of a left and right side in accordance with the preferred embodiment of the invention.

FIG. 2 is a perspective view of the repair flange mechanically fastened in place under a closet flange showing toilet bowl attachment bolts and attachment screws in place.

FIG. 3 is a cross-sectional view of the novel repair flange as seen along line 3 on FIG. 1 and line 3 on FIG. 2.

FIG. 4 is a perspective view of the repair flange consisting of a left side and right side in place under a closet flange in perspective location under a toilet bowl.

FIG. 5 is a cross-sectional view of the novel repair flange as seen along line 3 of FIG. 2 in place over a wood floor system. FIG. 5 shows a typical condition where gaps could exist between the floor material and the fastening screw from the closet flange.

FIG. 5 shows the repair flange supporting the closet flange bridging past the gap and fastened to the floor system outside the area covered by the closet flange.

FIG. 12 is a plan view showing the repair flange assembly attached to a floor support beneath the floor.

FIG. **12*a* is a plan view showing the repair flange assembly attached to the floor with use of an anchor bolt and FIG. 12*b*** is a plan view showing the repair flange assembly attached to the floor with the use of a toggle bolt.

FIG. 13 is a perspective view of the repair flange under the closet flange with a closet ring mounted directly to the closet flange for locating the assembly under a toilet bowl.

FIG. 14 shows a countersunk space to be made in a closet flange with an opening that will accommodate flat head screws.

FIG. 15 is a plan view showing the cross webbing that exists under the base of a toilet bowl.

DETAILED DESCRIPTION OF THE INVENTION

The present invention as states above is directed to an improvement over the repair flange of my patent U.S. Pat. No. 4,886,302. For purposes of comparison and to maintain continuity the features of the earlier patent will be briefly described in accordance with FIGS. 1-5.

Figure 1:
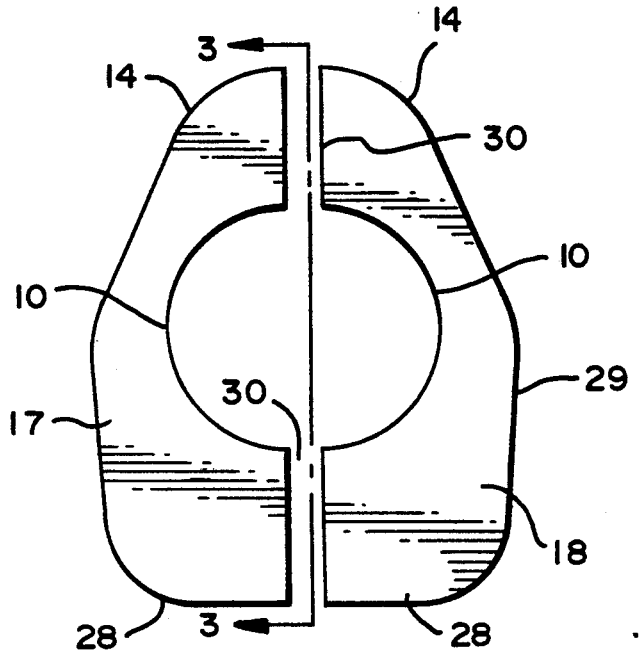
Figure 2:
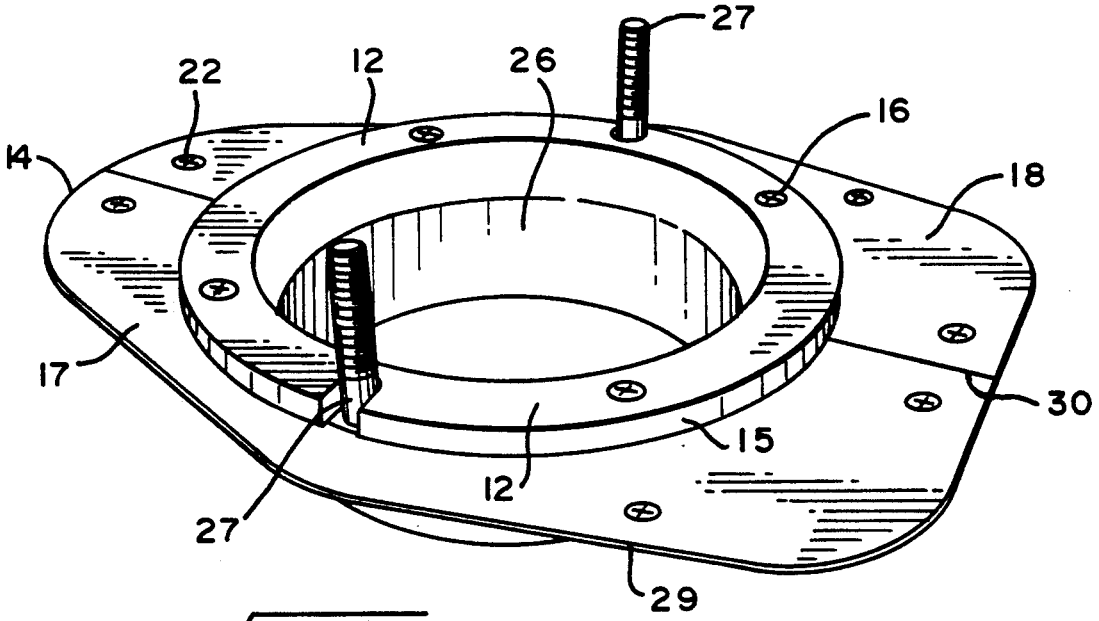
Figure 5:
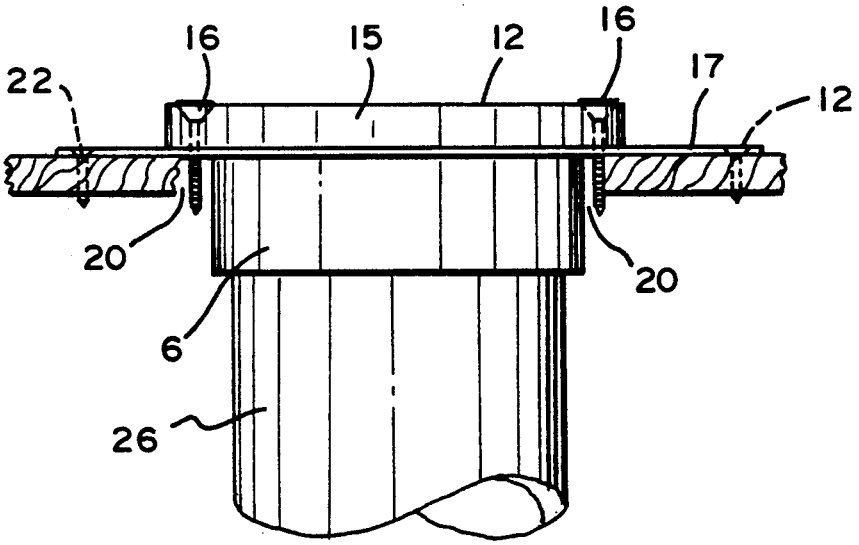

The invention of U.S. Pat. No. 4,886,302 is directed to a flat device consisting of a left and right side as shown in FIG. 1. The two sides left 17 and right 18 are designed to confront one another at the inner edge 30 to form a substantially circular opening 10 that fits in close relationship thereto around the neck of the closet flange 6. The front edge 28 extends out beyond the area covered by the base of the closet flange 12 which enables it to be attached or fastened to the floor material 9 with fastening means such as screws 22 outside the base of closet flange and the opening for the drain pipe 26 shown in FIG. 5. The circular edge 10, being in close relationship thereto fitted around the neck of the closet flange provides a strong and rigid surface under the attachment rim of the closet flange 12. This allows for a secure connection with the screws 16 located in the attachment rim of the closet flange even when a gap 20 exists between the floor material 9 and the attachment screws located in the rime of the attachment closet flange. The repair flange provides an attachment surface in situations where the floor material does not provide sound gripping for the attachment screws. FIG. 5 shows gap 20 existing between the closet flange and the edge of the floor material.

Figure 3:
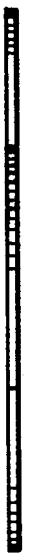
FIGS. 1–5 are duplicate of those shown in my prior patent as a means of comparison.

The device provides a rigid and sound surface when inserted between the closet flange and the floor material. The repair flange is fastened to through the closet flange with conventional fastening screws into the floor material outside the floor surface covered by the closet flange. The device is made from thin flat sheet material as shown in FIG. 3 and on the cross-sectional view of FIG. 5. This feature enables the device to be installed without disconnecting the closet flange from the drain pipe.

Figure 4:
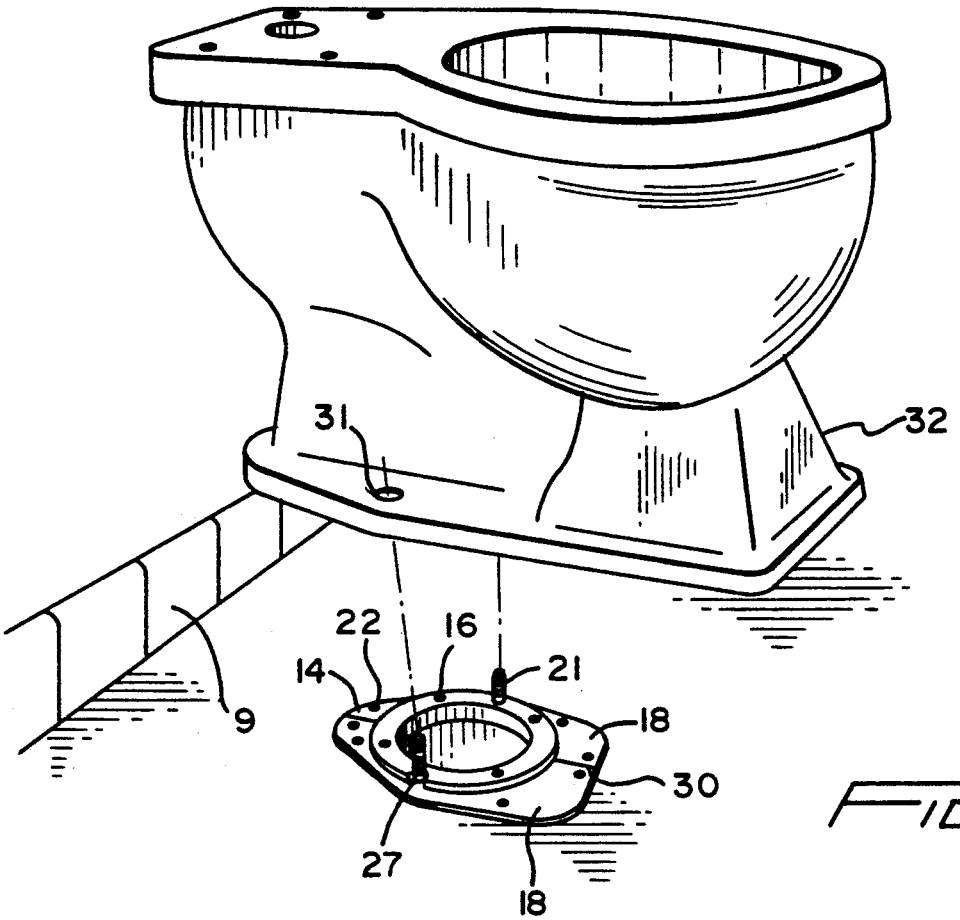

The repair flange is shaped so that it will be completely contained within the toilet bowl base 32 as illustrated in FIG. 4. The device provides a base for the toilet bowl attachment bolts 27 which are normally fastened through the opening in the base of the toilet bowl 31.

Figure 6:
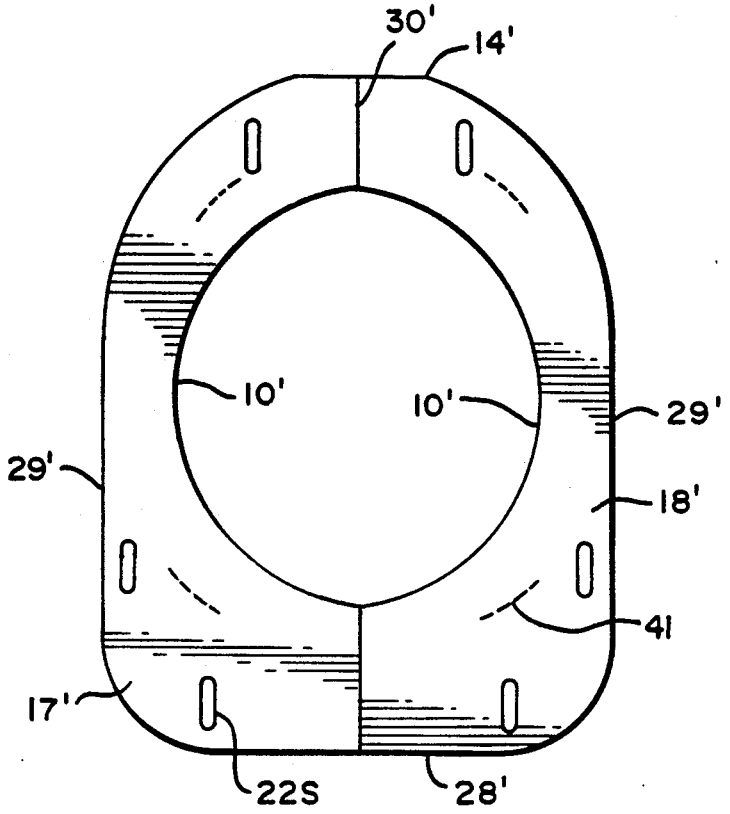
FIG. 6 is a plan view showing the repair flange sections in closed condition wherein the opening as shown as elliptical as opposed to a circular opening in the patent.

FIG. 6 shows the preferred shape of the invention which consists of two parts of thin, flat sheet material, preferably non-corrosive, having a straight front edge 28' rounded at their ends and extending vertically upward about two-thirds the length of the sheet to form respective left and right sides 17' and 18'. The sheet then extends arcuately upward and inward to back edge 14'. The arc ends about one inch from edge 30' where the sheets confront one another and when in closed formation form an elliptical opening 10'. The figure also shows alignment marks 41 spaced in four symmetrical positions about the flanges.

Figure 7:
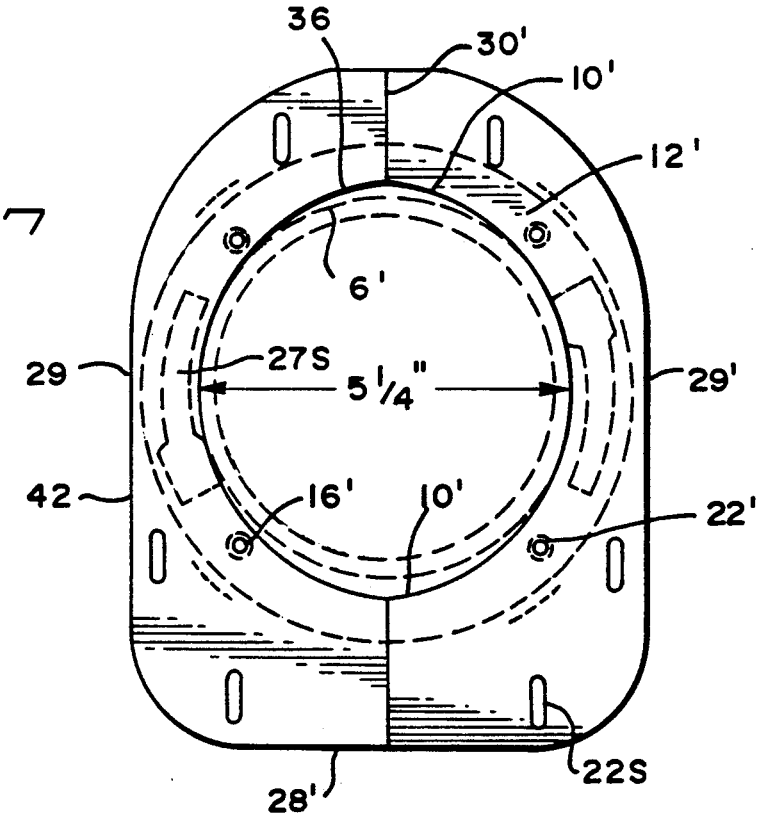
FIG. 7 is an embodiment of the improvement showing a plan view of the repair flange closed around the neck of a closet flange having an neck size approximately 5¼" in diameter.

FIG. 7 shows the repair flange fitted snugly about a closet flange having a neck diameter of about 5¼". Normally the neck is about 3 or 4 inches so that there is no problem in placing the repair flange sections flanges under the closet flange. However, when the neck is 5¼" and the standard repair flange circular opening is about the same, the use of an elliptical opening for the repair flanges permits a much easier fit. Preferably the elliptical opening is made so that the major axis runs vertically and the minor axis runs horizontally. Alignment marks 41 are arranged to assist in centering the repair flange parts around the neck and under the rim of the closet flange. By using the guide marks an equal amount of fastening surface under the screw holes of the closet flange rim is assured. Screws 16' fit into screw holes 22' and fasten the closet flange 12' to the repair flange sections 42. 22s represents slotted holes two of which are located near edge 28' on respective sides 17' and 18' and two at the back edge 14'. The slots afford latitude for shifting the flange sections either in front or back directions so that the flange sections fit properly under the screw holes, thereby enabling a rigid solid fastening surface to the floor. Additionally because of the ability to adjust fastening locations, obstruction of the cross webbing under the toilet base is avoided. Slots also allow the flange sections to be used on either the left or right side as well as being flip-flopped. The significance of this feature is that screw holes in closet flanges are rarely opposite one another as is the case where threads strip out of the repair flange sections. 27 are bolts which are fastened to the base of the toilet bowl through opening 31 (see FIG. 4). 36 shows the gap that exists between the circular neck of the closet flange and the elliptical opening between the flange sections when the flange sections are fitted close around the closet flange.

Figure 8:
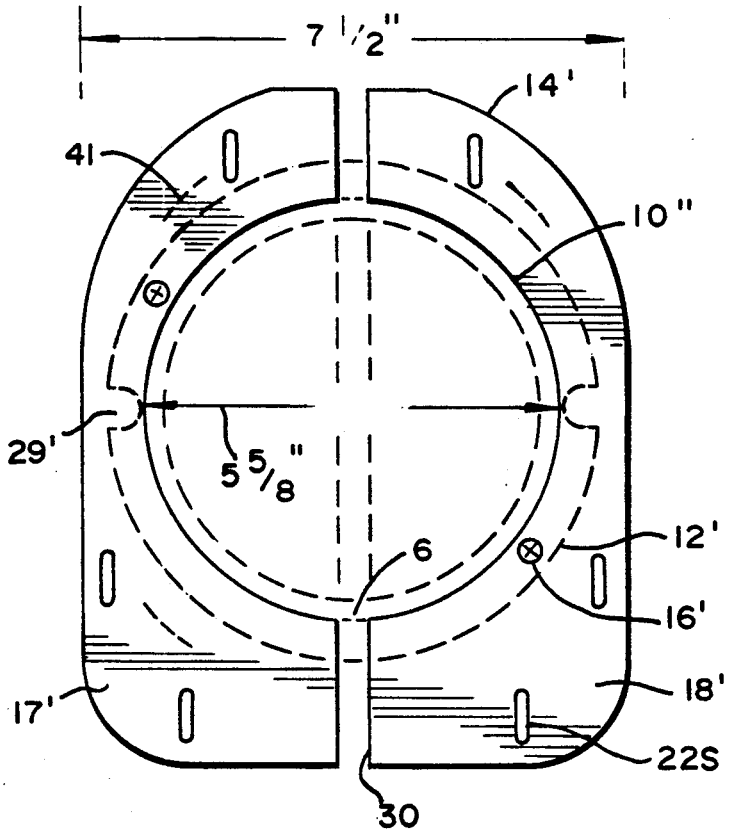
FIG. 8 is another embodiment showing a plan view of the repair flange sections spaced apart to accommodate a closet flange of about 5⅝" diameter.

FIG. 8 is illustrative of the situation where the neck of the closet flange is 5⅝". The flanges must be offset to accommodate the larger neck and the opening now reverts to a circular one. The overall length of the flange sections from side 17' to side 18' is now approximately 7½". Even with the flanges offset, there is still sufficient space so that the flange sections with the aid of the guide marks will be located under the screw holes of the closet flange with adequate fastening surface.

Figure 9:
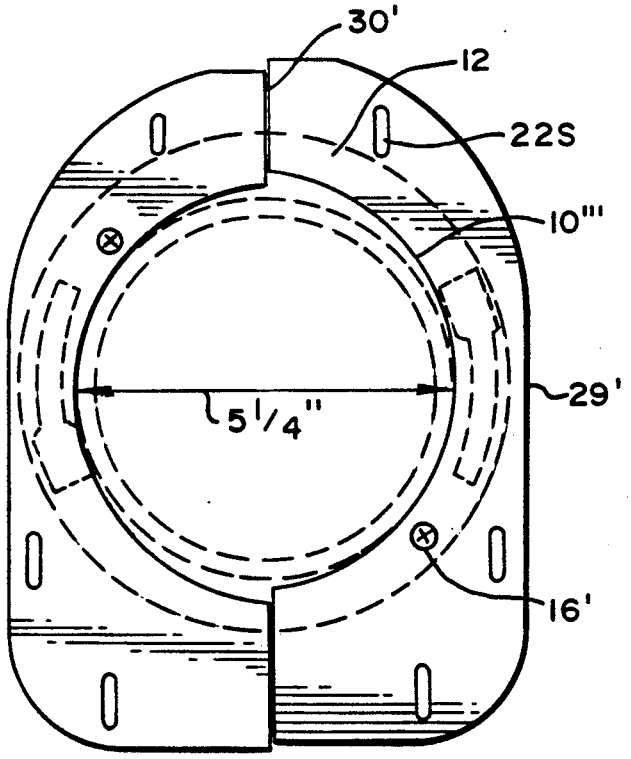
FIG. 9 is a third embodiment of a plan view showing the repair flange section closed around the 5¼" diameter neck of a closet flange wherein the repair flanges are staggered.

FIG. 9 shows an embodiment wherein the repair flanges need to be staggered to accommodate an approximately 5¼" closet flange. Staggering is necessitated by the fact that the closet flange is considerably misaligned from its usual position with respect to the location of the screw holes through the rim of closet flange. Staggering of the repair flange sections allows adequate coverage under the screw holes located in the closed flange. This staggering in conjunction with the use of slotted holes in the repair flange sections makes for an easier and more rapid assembly. As in FIG. 7 the repair flange sections form a close fit around the closet flange neck and the opening between flange sections is 10'''.

Figure 10:
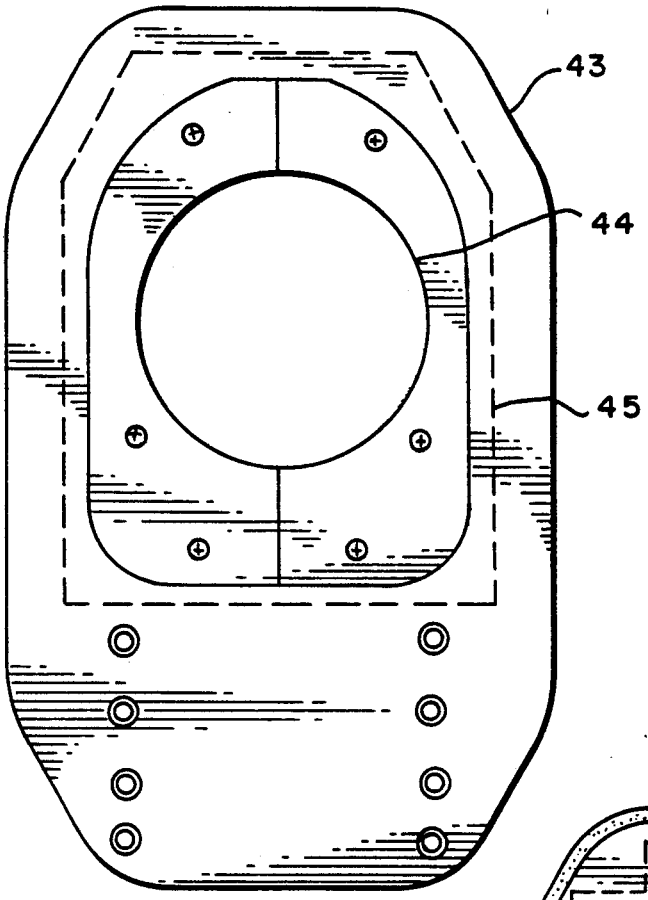
FIG. 10 is a fourth embodiment showing the addition of a planar surface to the repair flange.

FIG. 10 shows an embodiment wherein the surface of the repair flange is extended by attachment of an enlarged planar member 43. This member is generally rectangular, rounded at the ends and is about two feet in length and about one foot in width and somewhat thicker than the repair flange. About a quarter of the distance from the top edge and medially of the sides is a circular opening 44 just large enough to fit around the rim of the closet flange. On the underside, surrounding the circular opening is a recess 45 into which the raised repair flange fits. On the upper side of the member are a series of countersunk fastening holes. Four of these holes are located so as to enable fastening the member to the repair flange and make it an integral part thereof. The other openings enable fastening to the existing floor. These openings could also consist of holes or grooves or slots, etc. Optionally the same fastening means that fasten the repair flange to the flooring could also be used to fasten both the extended planar member and the repair flange to the flooring. This includes adhesives, epoxies and liquid glues. The extended member not only provides greater support for weak flooring but also serves as a cover plate. Sometimes it is necessary to change toilet bowls, which may be of different dimensions than the original. There would thus be gaps between the toilet bowl edge and the flooring. Since the extended member is greater than the perimeter of the toilet bowl, the extended member would cover these gaps.

Figure 11:
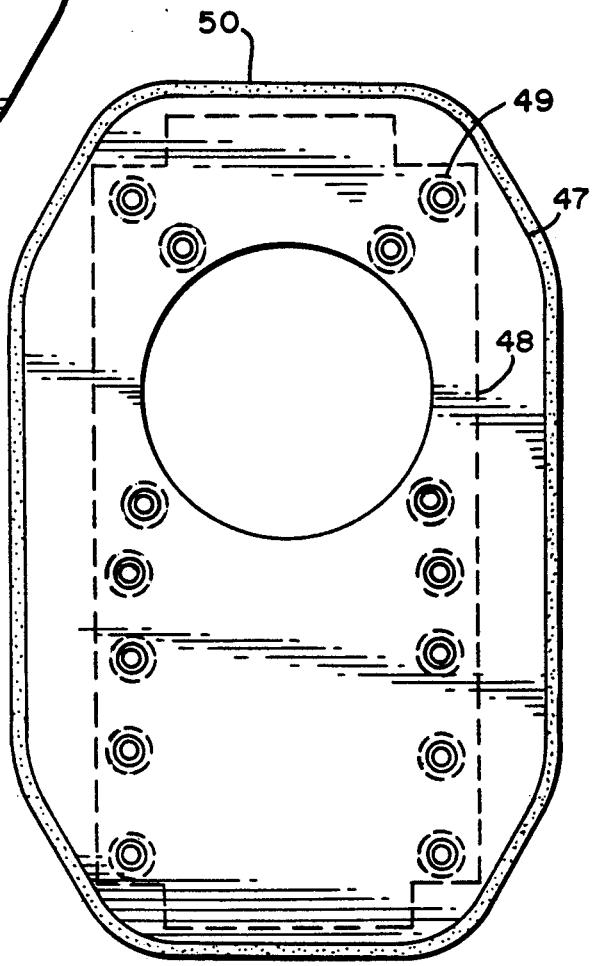
FIG. 11 shows a modified planar surface with a gasket attached to the rim and spacers attached to the underside.

FIG. 11 is a modification showing the planar member 47. The bottom of this member has a recessed area 48 generally rectangular but extending both longitudinally and laterally for all the member but a narrow strip at the respective edges and sides of the back member. The purpose of this modification is to take care of a situation where there is uneven flooring. An unrecessed planar surface over uneven flooring would likely create rocking of a fastened assembly because of high spots on the floor. By the same token low spots would make fastening of the surface to the flooring difficult. In addition to the countersunk spacers in the previously described floor surface, there are additional holes spaced longitudinally along each side of the member. Beneath each of these holes is placed a spacer 49 which can be molded to the underside, secured by an adhesive or placed under the hole manually. The spacer not only adjusts leveling of the extended member with the flooring, but also prevents cracking or breaking of the planar member, which occurs as a result of the pressure applied when torquing the fastening means. These spacers or protrusions can also be sanded individually to allow for isolated high spots in the floor. Additionally, around the periphery of the extended member is adhesively attached a gasket 50 which would be of the pressure resistant flexible type. The purpose of the gasket is to compensate for any unevenness in the surface where the extended surface joins the flooring.

FIG. 12 shows a board 51 installed under the floor and attached to joists 52. In some areas attachment of the repair flange to the flooring is inadequate to support the assembly, because the floor surface is too weak for the screws to make good contact. By placing a board across the joists under the floor, the screws create a sandwich effect with the flooring held firm between the repair flange and the board. On the other hand if joists are inaccessible or repair is made in a mobile home, the solution would be to secure the flooring to the repair flange with either one of hollow wall anchors 53 or toggle bolts 54.

FIG. 13 shows a closet ring 55 fastened and sealed directly over the closet flange. The closet ring is the same size and has the same geometry as the closet flange, except that as the name implies, it has no neck. Generally the horn of the toilet bowl fits over the rim of the closet flange and is held tight by the application of sealant, but on occasion it happens that the closet flange is somewhat depressed with respect to the floor and repair flange to which it is fastened or else the horn of the toilet bowl is somewhat elevated. By placing a closet ring over the closet flange, the horn of the toilet bowl and the closet flange can be successfully joined without voids that would cause leakage.

FIG. 14 shows the type of hole used in the closet flange through which the screws are inserted to fasten to the repair flange sections. Unlike U.S. Pat. No. 4,886,302 that used fastening screws 16, 16 are flat head screws which are mounted in countersunk spacers 56 surrounded by tapered washers 57 preferably made of nylon, and passing through opening 58. This use of tapered washers allows the same size screw for both small and large countersunk attachment holes. The nylon washers cushion the self tightening screw when tightening with power fasteners. The cushion also helps prevent stripping threads in the repair flange sections as the self tapping screw draws the closet flange near to the repair flange sections. These washers also act as spacers to keep the screw from making contact to the screw holes in the closet flange to the repair flange past the threads created by the tapping screws.

FIG. 15 shows the cross webbing 59 that exists under the base of a toilet bowl. As pointed out none of the flange sections in the embodiments represented by FIGS. 7 or 9 should lap lest they cause an obstruction to the cross webbing and the supporting edges under the base of the toilet bowl. The use of slots in the repair flanges also allows adjustments in screw location that might also obstruct the cross webbing. Even after screws are installed, they can be loosened so that the flange sections can be shifted.

The foregoing detailed description of the invention clearly demonstrates the advantages and improvements of this invention over my prior patent. These include versatility and adaptability to various size closet flanges, ease of locating the repair flange sections with respect to the closet flange and more secure fastening amongst other things.

I claim as follows:

1. In combination with a closet flange having a neck and a plurality of circumferentially spaced screw holes and a floor surface supporting a toilet bowl base thereon such as commonly found in bathrooms, a repair flange anchored to the floor and secured to the underside of an attachment rim of the closet flange and becoming an integral part of the closet flange so as to extend the anchoring surface of the closet flange over a larger area of said floor surface that exists under the toilet bowl base and received over gaps in deteriorated and poorly cut openings underneath the attachment rim of said closet flange, said repair flange comprising substantially rigid, flat sheet flange members of predetermined shape, each member having an outer, peripheral edge portion which comprises a front, back and side edge, said edges being dimensioned so that each flange member is contained within the base of the toilet bowl, the improvement wherein said flange members also include inner edge portions defining a substantially elliptical opening so that said flange members can accommodate closet flanges of various sizes and shapes, said inner edge portions located medially respective outer peripheral edges, said inner edge portions surrounding in close relationship thereto the neck of said closet flange underneath the rim of said closet flange, the flange members fitting neatly under the screw holes of the closet flange, said repair flange members having a plurality of vertically oriented slots spaced in such said flange members, fastening means engaging said flange members through said slots to secure said flange members to said underlying floor surface, a plurality of arcuate guide marks located so as to be radially outward from the rim of the closet flange, countersunk spacers and washers adjacent thereto radially spaced around the rim of said closet flange for accommodating fasteners that secure said closet flange to said flange members.

2. The combination of claim where said fasteners are flat head screws and said flange members are non-corrosive.

3. The combination of claim 1 wherein the inner edges of said flange members are spaced from each other a sufficient distance to accommodate a larger neck flange than flange members whose inner edges are proximate one another, said flange members being arranged to fit in close relationship with the neck of the closet flange.

4. The combination of claim 3 wherein the neck diameter of the closet flange is about 5⅝" and the overall dimension from side to side is about 7½".

5. The combination of claim 1 wherein the inner edges of said flange members are proximate each other and staggered around the neck of a closet flange that is offset with respect to the location of the toilet bowl base, said staggering enabling adequate fastening space under the screw holes in the closet flange.

6. The combination of claim 5 wherein said flange members extend arcuately inward from said vertically upper sides to a point at the back some distance from said inner edge, then extend horizontally to said inner edge and vertically downward to said opening.

7. The combination of claim 1 wherein the major axis of the elliptical opening runs longitudinally between the inner edges of said flange members and said minor axis runs laterally from a line drawn medially between sides of such flange members, the neck diameter of the closet flange is about 5¼" and overall dimension from side to side of said flange members is about 7150 ".

8. The combination of claim 1 wherein said flange members have horizontal front edges substantially rounded at the ends and sides that extend vertically upward for about two-thirds the height of said flanges.

9. The combination of claim 1 wherein said slotted flange members are designed to be interchangeable.

10. The combination of claim 9 wherein said washers are flat and are formed of nylon and said countersunk spacers and said flat nylon washers adjacent thereto are radially spaced around the rim of the closet flange for accommodating flat head screws that secure said closet flange to said flange members, said nylon washers assuming the contour of said countersunk spacers when said screws are torqued.

11. The combination of claim 1 wherein the anchoring surface of said repair flange is extended by fastening an substantially rectangular planar member about a quarter inch thick thereto, said planar member having a substantially circular opening that surrounds the closet flange, a plurality of spaced counter sunk holes, through which the screws are inserted and a rectangular recessed area on the underside for fitting said planer member over said repair flange so that said planer member will be level with the floor surface, said planer member extending a considerable distance beyond the edge of the toilet bowl base.

12. The combination of claim 11 wherein the underside of said planer member is recessed for a substantial distance both longitudinally and laterally beyond the region of the repair flange, a plurality of countersunk holes spaced longitudinally on each side of such surface and a plurality of spacers located directly beneath said holes, said spacers being about the thickness of said recess, fastening means for securing said planer member to the flooring in said recessed area beyond the region of the repair flange, said planer member having an outer edge and a flexible pressure type gasket adhesively joined to said outer edge.

13. The combination of claim 11 wherein the recessed area of the planer member includes dimples over the slots of the repair flange to accommodate raised fasteners.

14. The combination of claim 13 wherein said raised fasteners are raised screws.

15. The combination of claim 13 wherein said raised fasteners are raised bolt heads.

16. The combination of claim 1 wherein a board of substantial thickness is fastened between joists and said flooring is sandwiched between said board and said repair flange by extending said fastening means through said board.

17. The combination of claim 1 wherein a closet ring having the same dimension and shape as the closet flange is fastened proximate the closet flange, said toilet bowl base having a horn fitted directly on said closet ring and sealed.

18. The combination of claim 1 wherein the repair flange is fastened to the floor by hollow wall anchors.

19. The combination of claim 1 wherein the repair flange is fastened to the floor by toggle bolts.

20. In combination with a closet flange having a neck and a plurality of circumferentially spaced screw holes and floor surface supporting a toilet bowl base thereon such as commonly found in bathrooms, a repair flange anchored to the floor, and secured to the underside of the attachment rim of the closet flange and becoming an integral part of the closet flange so as to extend the anchoring surface of the closet flange over a larger area of the finished floor surface that exists under the toilet bowl base and received over the gaps in deteriorated and poorly cut openings underneath the attachment rim of said closet flange, the improvement wherein said repair flange comprises a pair of substantially rigid, flat, noncorrosive sheet flange members of predetermined shape, each flange member having outer, peripheral side edge portions and substantially vertical inner edge portions, proximate each other and having and defining a curved opening in the form of an ellipse, having a major axis and a minor axis, said major axis extending from the juncture of said edges longitudinally and said minor axis extending laterally from a line drawn medially from one side of said flange member to said other side, said inner edges surrounding in close relationship thereto the neck of said closet flange underneath the rim of said closet flange, the flange members fitting neatly under the screw holes of the closet flange, said flange members having a plurality of vertically oriented slots located on said front, back and sides of said flange members, screws engaging said flange members through said slots to secure said flange members to said underlying floor surface and a plurality of arcuate guide marks located so as to be radially outward from the rim of the closet flange.

* * * * *